US009796458B2

(12) United States Patent
Roodenburg et al.

(10) Patent No.: US 9,796,458 B2
(45) Date of Patent: Oct. 24, 2017

(54) OFFSHORE DRILLING VESSEL

(71) Applicant: ITREC B.V., Schiedam (NL)

(72) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 15/123,526

(22) PCT Filed: Feb. 27, 2015

(86) PCT No.: PCT/NL2015/050122
§ 371 (c)(1),
(2) Date: Sep. 2, 2016

(87) PCT Pub. No.: WO2015/133892
PCT Pub. Date: Sep. 11, 2015

(65) Prior Publication Data

US 2017/0073046 A1 Mar. 16, 2017

(30) Foreign Application Priority Data

Mar. 3, 2014 (NL) ..... 2012351

(51) Int. Cl.

| | |
|---|---|
| ***E21B 7/12*** | (2006.01) |
| ***E21B 15/02*** | (2006.01) |
| ***B63B 35/44*** | (2006.01) |
| ***E21B 33/064*** | (2006.01) |
| ***E21B 19/084*** | (2006.01) |

(Continued)

(52) U.S. Cl.
CPC ..... *B63B 35/4413* (2013.01); *B63B 27/04* (2013.01); *E21B 7/128* (2013.01);
(Continued)

(58) Field of Classification Search
CPC ..... E21B 7/128; E21B 15/02; E21B 19/002; E21B 19/084; E21B 19/09; E21B 19/143; E21B 33/064; B63B 27/04; B63B 35/4413
See application file for complete search history.

(56) References Cited

U.S. PATENT DOCUMENTS 3,333,562 A * 8/1967 Deal, Jr. ..... B63B 35/00 114/264
3,718,266 A * 2/1973 Donnally ..... E21B 33/064 104/121

(Continued)

FOREIGN PATENT DOCUMENTS

CN 102123906 A 7/2011
GB 1 468 635 3/1977

(Continued)

OTHER PUBLICATIONS

English translation of Chinese Office Action for Chinese Application No. 201580011879.2, dated Mar. 29, 2017.

*Primary Examiner* — Matthew R Buck
(74) *Attorney, Agent, or Firm* — Birch, Stewart, Kolasch & Birch, LLP

(57) ABSTRACT

An offshore drilling vessel includes a main deck, a moonpool a firing line hoist system having a tower, a BOP transport system and a pivotally supported U-shaped working deck. The U-shaped working deck can be pivoted between an active position, in which it extends in a substantially horizontal direction such that it covers a portion of the moonpool, and a non-active position, in which it extends in a substantially vertical direction such that it provides room for a BOP to be moved by the BOP transport system from a storage position adjacent the moonpool into a launch
(Continued)

position above the moonpool, in which launch position the BOP is located between the tower and the working deck.

17 Claims, 3 Drawing Sheets

(51) Int. Cl.

| | |
|---|---|
| ***B63B 27/04*** | (2006.01) |
| ***E21B 7/128*** | (2006.01) |
| ***E21B 19/00*** | (2006.01) |
| ***E21B 19/09*** | (2006.01) |
| ***E21B 19/14*** | (2006.01) |
| *B63B 3/14* | (2006.01) |

(52) U.S. Cl.
CPC ..... *E21B 15/02* (2013.01); *E21B 19/002* (2013.01); *E21B 19/084* (2013.01); *E21B 19/09* (2013.01); *E21B 19/143* (2013.01); *E21B 33/064* (2013.01); *B63B 2003/147* (2013.01)

(56) References Cited

U.S. PATENT DOCUMENTS

| | | | | |
|---|---|---|---|---|
| 8,079,426 | B2 * | 12/2011 | Petersson | B63B 35/4413 114/264 |
| 2010/0116507 | A1 * | 5/2010 | Haugland | E21B 19/002 166/352 |
| 2011/0048310 | A1 * | 3/2011 | Roodenburg | B63B 35/4413 114/268 |
| 2015/0090464 | A1 * | 4/2015 | Johnston | E21B 19/002 166/385 |
| 2015/0183495 | A1 * | 7/2015 | Chiu | B63B 35/4413 114/44 |

FOREIGN PATENT DOCUMENTS

| | | |
|---|---|---|
| WO | WO 2008/121071 A1 | 10/2008 |
| WO | WO 2009/102196 A2 | 8/2009 |
| WO | WO 2009/102197 A2 | 8/2009 |

* cited by examiner

OFFSHORE DRILLING VESSEL

FIELD OF THE INVENTION

The present invention relates to an offshore drilling vessel, e.g. for oil and gas exploration, well servicing, etc.

BACKGROUND OF THE INVENTION

In WO2009/102197, which is incorporated herein by reference, firing line hoist systems to be mounted on the hull of a monohull drilling vessel are disclosed. In general these known firing line hoist systems comprise:

- a tower, which tower has a top side and a base, a first side and a second side, and wherein the base of the tower is connected to the hull of the drilling vessel at opposite sides of a moonpool, such that the first side of the tower and the second side of the tower bridge the moonpool in a lateral direction thereof, and
- a hoisting device, which hoisting device comprises a load attachment device displaceable supported by the tower, one or more cables and one or more associated winches to manipulate the position of the load attachment device relative to the tower in a vertical direction along a firing line, which firing line extends on the outside of and adjacent to the first side of the tower and through the moonpool, and which hoisting device is adapted for raising and lowering a BOP (Blow Out Preventer) to the seabed;
- a BOP transport system, configured for moving a BOP between a storage position and a launch position, in which launch position the BOP is located in the firing line adjacent the first side of the tower, and in which launch position the BOP can be manipulated by the hoisting device, wherein the BOP transport system comprises two parallel guide rails and a BOP transport cart which is movably supported by those guide rails; and
- a mobile working deck that is provided at the first side of the tower, and which working deck in an active position extends in a substantially horizontal direction and covers a portion of the moonpool, while the firing line extends through the working deck, and in a non-active position provides room for a BOP to be moved by the BOP transport system into a launch position above the moonpool.

By arranging the mobile working deck in a mobile manner the deck can be provided in a relative low position with respect to the waterline when work has to be carried out on the working deck, e.g. assembly of a riser string or a drill string. The mobile working deck is removed when a BOP is to be positioned in the firing line. After the BOP has been positioned in the firing line, and has been lowered, the mobile working deck is returned into its active position.

In case the mobile working deck is a sliding working deck, after the BOP is brought into the firing line the BOP is lowered onto a cart positioned above the moonpool. The mobile deck is returned into its active position. The BOP may then be attached to a hosting device and raised with its top end to the level of the working deck, so as to suspend the BOP from a suspension device of the working deck. Subsequently a riser section is connected to the top end of the BOP, and the BOP and riser section are lowered by means of the hoisting device into the sea. This is an elaborate process.

When the mobile working deck is provided with lifting means, the mobile working deck has to be lifted along the tower of the firing line hoist system, such that the BOP can be brought underneath the mobile working deck. The tower is preferably provided with a deck holding device at an elevated position along the tower to hold the deck in the raised, non-active position. It is noted that the working deck is configured for supporting substantially heavy loads, and therefore is quite heavy itself. The deck holding device and the tower should therefore be dimensioned to support the heavy working deck at a substantial height above the main deck. Furthermore the mobile deck may be arranged pivotally, so that e.g. it can be brought in a vertical non-active position. For instance the mobile deck may have two pivotable deck parts.

OBJECT OF THE INVENTION

The present invention aims to propose solutions to make optimum use of the firing line hoist system on an offshore drilling vessel. In particular, the present invention aims to provide an improved mobile working deck configured for use with a firing line hoist system of an offshore drilling vessel.

SUMMARY OF THE INVENTION

The present invention provides an offshore drilling vessel comprising:

- a hull having a moonpool;
- a main deck, which main deck is supported by the hull,
- a firing line hoist system, which firing line hoist system is supported by the hull, the firing line hoist system comprising:
- a tower, which tower has a top and a base, a first side and a second side, and wherein the base of the tower is connected to the hull of the drilling vessel at the moonpool such that the first side of the tower faces the moonpool, and
- a hoisting device, which hoisting device comprises a load attachment device displaceable supported by the tower, one or more cables and one or more associated winches to manipulate the position of the load attachment device relative to the tower in a vertical direction along a firing line, which firing line extends on the outside of and adjacent to the first side of the tower and through the moonpool, and which the hoisting device is adapted for raising and lowering a BOP to the seabed;
- a BOP transport system, provided at the first side of the tower and configured for moving a BOP between a storage position adjacent the moonpool and a launch position above the moonpool, in which launch position the BOP is located in the firing line and can be manipulated by the hoisting device, which BOP transport system comprises:
- a BOP transport track, which BOP transport track comprises two parallel guide rails that are supported by the hull such that they bridge the moonpool in a lateral direction thereof; and
- a BOP transport cart, which transport cart is movably supported by the guide rails;
- a U-shaped working deck, which U-shaped working deck is provided at the first side of the tower above the parallel guide rails of the BOP transport system, which U-shaped working deck comprises a base part, and two leg parts, which leg parts are with a proximal end connected to said base part at spaced apart locations such that the leg parts between them define an elongate slot for receiving a tubular supported in the firing line, the elongate slot having a closed end, located in a central area of the U-shape working deck between the proximal ends of the legs, and an open end, located at a side of the U-shaped working deck between distal ends of the legs, wherein the U-shaped working deck is pivotally supported such that it can be pivoted about a working deck pivot axis, which working deck pivot axis extends parallel to the guide rails of the BOP transport track and is provided at a distance from the tower such that the BOP transport track extends between the pivot axis and the tower, and wherein a working deck pivot drive is provided that can pivot the U-shaped working deck about said pivot axis between:

an active position, in which the U-shaped working deck preferably rests on the guide rails of the BOP transport track, and extends in a substantially horizontal direction such that it covers a portion of the moonpool while the firing line extends through the elongate slot at the closed end thereof, and a non-active position, in which the U-shaped working deck clears the BOP transport track and extends in a substantially vertical direction such that it provides room for a BOP to be moved by the BOP transport system into its launch position above the moonpool between the tower and the U-shaped working deck, and wherein the U-shaped working deck is pivotably supported at its base part, such that when the U-shaped working deck is pivoted from its non-active position into its active position while a tubular is supported in the firing line, the tubular is received in the elongate slot between the two leg parts.

According to the invention, the working deck is provided in the form of a pivotable U-shaped working deck.

The U-shaped working deck with the elongate slot and pivot axis at its base end, provides a working deck that can be pivoted into and out of its active position while the firing line is in use, i.e. while a tubular such as a riser is supported in the firing line at the working deck level.

The U-shape with the elongate slot furthermore allows for a working deck with a unitary structure, that clears the BOP transport track by being pivoted away from the tower of the firing line hoist system. The U-shaped working deck thus allows for a BOP transport system with two storage positions on opposite sides of the moonpool and a BOP transport track that runs closely adjacent the tower of the firing line hoist system, without the need of additional tracks and/or supports for transporting the working deck into, and supporting the working deck in, its non-active position.

Also, by arranging the working deck in a mobile manner the deck can be in a relative low position with respect to the waterline when work has to be carried out on the working deck, e.g. assembly of a riser string or a drill string. In contrast, a fixed deck should be located high enough to allow a BOP to be moved below the working deck into and out off its storage position. By providing a pivotable mounted working deck, the working deck can be simply and quickly removed. Also, by pivoting the deck into an upright non-active position, the centre of mass of the working deck stays in a relatively low position with respect to the waterline when the deck is in its non-active position. Furthermore, in its upright position, the working deck requires a minimum of deck space.

Furthermore, pivoting the working deck from its active position in a direction upwards and away from the tower, frees up the first side of the tower above the BOP transport track, more in particular above the rails of the BOP transport track. Thus, the deck, when in its non-active position, does not form an obstruction for the hoisting device of the hoist system, which enables the hoisting device to further lower a supported object, for example lower a BOP onto a cart provided below deck above the moonpool. For example, when according to the prior art a mobile working deck is provided, which mobile working deck is to be lifted into its non-active position and lowered into its active position, the working deck can not clear the first side of the tower and thus limits the range of the hoisting device. Therefore, in the prior art a tubular, for example a riser section, needs to be provided between the hoisting device and a BOP to enable the hoisting device to lower the BOP on a cart above the moonpool. Use of such a tubular can be avoided by providing a pivotally supported U-shaped working deck according to the invention. Thus, the hoisting device can be directly coupled with a BOP and still lower the BOP onto a cart provided below deck, above the moonpool.

Furthermore, when the hoist system is provided with guides, for example guide rails or I-beams, for guiding the hoisting device in a vertical direction along the first side of the tower, providing a pivotally supported U-shaped working deck allows for those guides to extend below deck level. The guides can thus extend in a downward direction towards, and preferably end adjacent, the guides of the BOP transport track. By allowing the guides to extend below deck level such that they end at the BOP transport track, the range of the hoisting device is further increased.

Thus, the invention provides a working deck that allows for making optimum use of a firing line hoist system of an offshore drilling vessel, in particular provides an improved mobile working deck configured for use with a firing line hoist system of an offshore drilling vessel.

It will be appreciated that the pivotable U-shaped working deck is configured to, in its active position, support the weight of the suspended string of tubulars. In a practical embodiment said weight will be at least 200 tonnes, so the working deck has a structure that allows for supporting a string of tubulars, e.g. risers, possibly with a BOP attached to the lower end of the string, having a weight of at least 200 tonnes.

In an embodiment according to the invention, the U-shaped working deck is configured such that, when in its active position, it rests on the working deck pivot axis at one side of the BOP transport track and at dedicated working deck supports at the opposite side of the BOP transport track. In an embodiment the tower and/or working deck are/is provided with dedicated working deck supports in the form of retractable support pins that, when the working deck has been pivoted into its active position, are inserted into the deck and/or tower, such that they support the working deck in its active position.

In a preferred embodiment, the working deck according to the invention is configured such that when the deck is in its active position, its rests on one or both guide rails of the BOP transport system. Thus, optimum use is made of the BOP transport system, the guide rails of which are provided and configured to support large loads. In an embodiment the working deck rests on the working deck pivot axis at one side of the BOP transport track and on a guide rail of the BOP transport track at the opposite side of the BOP transport track. In an alternative embodiment, the working deck rests with opposite ends on the guide rails of the BOP transport track. In this configuration, the load on the working deck pivot axis is reduced since at least a major part of the weight of the working deck, and objects supported by that working deck, is supported by the guide rails of the BOP transport system. Since the guide rails are already configured to support large loads, dimensioning the guide rails to support the load of the working deck is less complicated than providing dedicated supports.

Preferably, the pivotable working deck is provided with support beams that form a frame for supporting loads supported by the working deck, which support beams are provided with contact surface areas with which the support beams are positioned on the guide rails of the BOP transport system when the working deck is in its active position.

In a further embodiment, the U-shaped working deck comprises at least two main support beams, which main support beams extend parallel to the legs of the U-shaped working deck on opposite sides of the elongate slot, such that the two main support beams cross the BOP transport track when the U-shaped working deck is in its active position.

Preferably, the main support beams rest directly on one, preferably on both of the rails of the BOP transport system when the U-shaped working deck is in its working position. Preferably, the two or more main support beams, extend from one end of the working deck up to the opposite end of the working deck. Such a configuration provides a simple and reliable working deck that can support large loads.

In an embodiment, the U-shaped working deck is provided with a suspension device, which suspension device is preferably attached to support beams, preferably below the deck surface of the working deck, such that a load supported by the suspension device is transferred directly from the suspension device to the support beams. The suspension device preferably is configured to suspend a riser string, preferably with a BOP attached to the lower end of the riser string, from the U-shaped working deck in the firing line. Thus the deck can for example be used for riser assembly and disassembly.

In an embodiment, the suspension device is integrated in the working deck, preferably below the deck surface of the working deck, and is configured such that it can be switched between a support position in which it engages a tubular in the firing a line and a retracted position in which it allows a tubular in the firing line to be lowered or raised via the elongate slot and/or another suspension device to be used to support a tubular in the firing line. In an embodiment, the suspension device comprises a clamp with two moveably supported C-shaped halves provided at the closed end of the elongate slot, preferably in the central area of the U-shaped working deck. The C-shaped halves are combined into a circular support ring for supporting a tubular at the closed end of the elongate slot and can be moved away from each other to clear the elongate slot. In another embodiment, a C-shaped clamp is provided with a door element for providing a ring shaped hang of clamp. Other configurations and/or types of clamps, for example a rotary table possibly combined with the riser spider and/or a gimbal, can also be combined with a U-shaped working deck according to the invention.

The elongate sloth of the U-shaped working deck preferably extends over more than half the length of the U-shaped working deck, such that the elongate slot extends from an opening provided at the side of the U-shaped working deck to a central area of the U-shaped working deck. In an embodiment, the length of the sloth is at least twice the width of the slot.

In an embodiment, the U-shaped working deck comprises movable deck parts, for example in the form of a removable hatch or a sliding deck part, for, when the deck is in its active position, covering part of the elongate slot, such that the elongate slot near the closed end remains uncovered to enable a tubular to be supported in the firing line such that it passes through the elongate slot. Thus the working area of the U-shaped working deck is increased and equipment can not fall into the elongate slot. It is submitted that these deck parts are provided for supporting mainly personnel and small loads, and do not substantially contribute to supporting a load of for example a riser string supported by the U-shaped working deck.

In an embodiment of an offshore drilling vessel according to the invention, the base of the tower is connected to the hull of the drilling vessel at the moonpool at opposite sides thereof, such that at least the first side of the tower and preferably also the second side of the tower bridges the moonpool in a lateral direction thereof. In a preferred embodiment the tower is provided above the moonpool such that both the first and the second side of the tower bridge the moonpool. In such an embodiment, a second firing line, extending on the outside of and adjacent to the second side of the tower and through the moonpool, can be provided. For example, such a tower can be provided with a second hoisting device at the second side of the tower. This second hoisting device can be similar to the first hoisting device and/or can for example be configured for handling drill strings.

Preferably, an offshore drilling vessel thus provided with a tower bridging the moonpool and a hoist system comprising a first and a second hoisting device, located respectively on the first and the second side of the tower, and thus with two firing lines, is at the first side of the tower configured for assembly, disassembly and handling of risers, and for handling of equipment relevant for risers, such as a BOP, and is at the second side of the tower configured for assembly, disassembly and handling of a drill string and equipment relevant for a drill string.

In a further embodiment, the firing line hoist system comprises two firing lines and is at both the first side and the second side of the tower configured for assembly, disassembly and handle drill strings and risers.

In an embodiment, in which the tower bridges the moonpool and is provided with a firing line on both the first and the second side of the tower, the vessel has a stationary working deck at the second side of the tower, and the pivotable working deck, when in its active position, is located at substantially the same height as the stationary working deck is located. This is most preferred if the vessel is provided with one or more setbacks, e.g. carrousels, for joints of drill pipes, e.g. at both lateral sides of the tower, so that drill pipe joints can easily be transferred from each of said setbacks to either firing line. It is noted that a different height of working decks at opposed sides of the tower is also possible within the scope of this application.

When the firing line hoist system is provided with two firing lines of which one is dedicated to drilling and the other is dedicated to riser assembly and disassembly, the U-shaped working deck is preferably provided at the side with the hoisting device dedicated to riser assembly and disassembly. In an embodiment of an offshore drilling vessel according to the invention, a pivotable U-shaped working deck is provided on both sides of the tower, for example when both hoisting devices are used for drilling as well as for riser string assembly and disassembly.

In an embodiment, the pivotable U-shaped working deck, when in its active position, is located at substantially the same height as the main deck, preferably is part of the main deck such that objects can be moved in a horizontal direction from the main deck onto the working deck.

In a further embodiment, the main deck is provided with transport rails for supporting carts to transport objects over the main deck, and the U-shaped pivotable working deck is provided with transport rails, which, when the pivotable working deck is in its active position, are in line with transport rails provided on the working deck such that a cart can be driven over the transport rails from the main deck onto the U-shaped pivotable working deck and visa versa. Thus the U-shaped pivotable working deck is part of the main deck, which allows for efficient use both the main deck and the U-shaped working deck since they are combined into a single large deck area which enables easy exchange of personnel and equipment between the decks. Furthermore, the rails enable heavy equipment to be easily transferred between the decks, for example between a storage position on the main deck and an active position on the U-shaped working deck.

Preferably the U-shaped pivotable working deck is provided with support means, e.g. transport rails, for an iron roughneck. It is preferred to provide the tower with a storage compartment for the iron roughneck at the side of the U-shaped pivotable working deck, so that the iron roughneck can be stored in said compartment when not in use, e.g. the compartment having rails that may be aligned with the rails on the U-shaped pivotable working deck to move the iron roughneck over the rails.

It is observed that the tower supporting the hoisting device, more in particular the load attachment device of the hoisting device, can for example be provided in the form of mast or similar hollow structure, or in the form of a derrick or similar structure.

It is furthermore noted that the vessel can be of different embodiments, yet a mono-hull vessel is in particular contemplated. The vessel could however also be, for example, a semi-submersible vessel with parallel pontoons and columns supporting a deck box structure or with an annular pontoon, e.g. for arctic environments. The vessel could also be a jack-up type drilling rig, with extendible legs, e.g. the tower and moonpool being present on a cantilever onboard the jack-up type vessel.

In an embodiment, the offshore drilling vessel according to the invention is a monohull drilling vessel, the monohull having an elongate shape extending along a longitudinal axis, wherein the moonpool has an elongate shape extending along a longitudinal axis, the latter being parallel with the longitudinal axis of the monohull drilling vessel. In such an embodiment, the hull typically has a front, or bow, and a stern. Preferably the first side of the tower is directed to the stern of the hull and the second side of the tower is directed towards the front of the hull.

In a further embodiment, a front main deck portion of the main deck extends forward of the moonpool and a rear main deck portion of the main deck extends rearward of the moonpool, and the base of the tower extends between a section of the hull on portside and a section of the hull on starboard side such that it bridges the moonpool.

In a further embodiment the base of the tower is spaced from the bow side and from the stern side of the moonpool, thereby forming a front moonpool area forward of the tower and a rear moonpool area rearward of the tower.

It is observed that a U-shaped working deck according to the invention is especially suitable for use with a monohull drilling vessel since these types of vessels are typically provided with a firing line hoist system comprising a tower and one or two hoisting devices, and a BOP transport system comprising a BOP transport track extending in a lateral direction over the moonpool adjacent the tower of the firing line hoist system. In a preferred embodiment according to the invention, the BOP storage location is offset, preferably laterally offset, from the first firing line, and a BOP transfer device such as a cart is provided for displacement of the BOP into the first firing line In a possible embodiment the BOP transport system includes one or two BOP transport carts, displaceable over the guide rails of the BOP transport track, which carts are provided with a BOP support frame. Preferably the BOP support frame has a central opening for the BOP to extend through, so that a top portion of the BOP extends above the BOP support frame and a lower portion below the BOP support frame. Supporting the BOP in this manner results in a stable holding of the BOP, e.g. advantageous over a solution where the BOP is supported on the underside or supported from the upper end.

In a preferred embodiment the BOP support frame is provided with actuable BOP supports that in active position support the BOP and in retracted position release the BOP (commonly after the BOP has been attached to a riser held by the first hoisting device).

In a preferred embodiment the BOP support frame is provided with a lateral opening that allows for a tubular supported in the firing line, for example a riser held by the hoisting device and supporting a BOP, to be moved, in a lateral direction relative to the BOP transport cart, into or out of the BOP support frame. More in particular, the lateral opening in the BOP support frame of the BOP transport cart allows the transport cart to be moved into and out off a position for receiving a BOP in its launch position while a tubular is supported in the firing line at the level of the BOP transport cart. Thus, by moving the BOP transport cart along the BOP transport track, a tubular supported in the firing line can be brought within the confinement of the BOP support frame, i.e. in a central opening of the frame for receiving a BOP.

In a further embodiment, the BOP transport cart is provided with a door or insert, for closing off the lateral opening of the BOP transport frame, more in particular to provide a structural connection between section of the BOP support frame on opposite sides of the lateral opening, to provide the support frame with additional structural strength and/or rigidity while supporting the BOP. In such an embodiment, the door or insert, is removed when the BOP cart is moved in position above the moonpool, and replaced prior to the BOP being received by the support frame.

In an embodiment, the guide rails of the BOP transport track are provided in the form of beams that cross the moonpool, and that are supported by the hull on opposite sides of the moonpool, and at least one, preferably two, of the guiderails of the BOP transport track is/are provided with a guide surface for supporting and guiding the at least one BOP transport cart and with a separate support surface for supporting the U-shaped working deck.

By thus providing the guide rail or guide rails with an additional support surface for supporting the U-shaped working deck, the U shaped working deck does not contact the guide surfaces for guiding the BOP transport carts when the U-shaped working deck rests on the guide rails in its active position. Thus, it is prevented that the BOP transport cart guide surface of the guide rails gets damaged by supporting the U-shaped working deck when in its active position.

The invention furthermore provides a drilling method wherein use is made of an offshore drilling vessel according to the invention.

As is preferred the tower of the firing line hoist system has a rectangular cross-section.

As is preferred the tower of the firing line hoist system is provided in the form of a mast, which mast has a contiguous outer wall, so that its interior is shielded from the weather.

In a further embodiment, the one or more winches of the first and optionally second hoisting device are arranged within the mast, preferably at the lower end of the mast of the firing line hoist system.

Preferably the vessel is provided with a rotary drilling drive, e.g. a top drive, at the second side of the tower and/or the first side of the tower of the firing line hoist system.

The invention furthermore provides a method of lowering a BOP from an offshore drilling vessel according to the invention, wherein the U-shaped working deck is pivoted in a direction upward and away from the tower, from its active position into its non-active position, and the BOP is brought into the first firing line thus cleared by the pivotally supported working deck.

It is observed that an embodiment of a BOP transport system as disclosed herein, i.e. a BOP transport system comprising a BOP transport cart having a BOP support frame with a lateral opening for receiving a tubular supported in the firing line, can be used with a vessel provided with a mobile working deck, for example a working deck that is lifted or skidded between an active position above the moonpool and an inactive position, also.

In this particular embodiment of the BOP transport system, the lateral opening in the BOP support frame of the BOP transport cart allows the transport cart to be moved into and out off a position for receiving a BOP, preferably via a bottom opening provided in that BOP support frame, in its launch position while a tubular is supported in the firing line at the level of the BOP transport cart. By moving the BOP transport cart along the BOP transport track, a tubular supported in the firing line can be brought within the confinement of the BOP support frame via the lateral opening provided in the BOP support frame.

Providing the BOP transport cart with such a lateral opening allows for a tubular supported in the firing line, for example a riser held by the hoisting device and supporting a BOP, to be received within the confines of a BOP support frame via said lateral opening by moving the BOP transport cart along the BOP transport track, or vice versa. This is beneficial when a BOP can be positioned within the BOP support frame via a bottom opening in that frame. Thus, when a BOP is supported via a tubular section, or similar, in the firing line by the hoisting device, the BOP transport cart can simply be moved in a BOP receiving position above the moonpool. By moving the BOP transport cart along the BOP transport track, the tubular section is received within the BOP support frame via the lateral opening. Once the BOP support cart is correctly positioned above the moonpool, the BOP can be lifted, and pass the bottom opening in the BOP support frame, subsequently, restraints are activated, such as pivotable support arms, and the BOP is secured in the BOP support frame. After the tubular has been disconnected from the BOP the BOP transport cart can be moved along the BOP transport track to position the BOP in its storage position.

Thus, the lateral opening in the BOP support frame allows for efficient process compared to those known in the prior art, in which the tubular has to be removed from the firing line to enable the BOP transport cart to be correctly positioned above the moonpool for receiving the BOP, after which the tubular has to be brought into the firing line again to lift the BOP into the BOP transport cart. While the tubular is removed from the firing line, the BOP has to be supported below the BOP transport track, for example on a skid cart above the moonpool.

Therefore, according to a second aspect, the invention furthermore provides an offshore drilling vessel comprising:

- a hull having a moonpool;
- a main deck, which main deck is supported by the hull,
- a firing line hoist system, which firing line hoist system is supported by the hull, the firing line hoist system comprising:
  - a tower, which tower has a top and a base, a first side and a second side, and wherein the base of the tower is connected to the hull of the drilling vessel at opposite sides of the moonpool, such that the first side of the tower and the second side of the tower bridge the moonpool in a lateral direction thereof, and
  - a hoisting device, which hoisting device comprises a load attachment device displaceable supported by the tower, one or more cables and one or more associated winches to manipulate the position of the load attachment device relative to the tower in a vertical direction along a firing line, which firing line extends on the outside of and adjacent to the first side of the tower and through the moonpool, and which the hoisting device is adapted for raising and lowering a BOP to the seabed;
- a BOP transport system, provided at the first side of the tower and configured for moving a BOP between a storage position adjacent the moonpool and a launch position above the moonpool, in which launch position the BOP is located in the firing line and can be manipulated by the hoisting device, which BOP transport system comprises:
  - a BOP transport track, which BOP transport track comprises two parallel guide rails that are supported by the hull such that they bridge the moonpool in a lateral direction thereof; and
  - a BOP transport cart movably supported by the guide rails, the BOP transport cart having a BOP support frame, which support frame is configured for receiving and/or releasing a BOP via a bottom opening and is provided with actuable BOP supports for supporting a BOP in the BOP support frame, and which BOP support frame is provided with a lateral opening for receiving a tubular supported in the firing line in the BOP support frame;
- a mobile working deck, which mobile working deck is provided at the first side of the tower above the parallel guide rails of the BOP transport system, and which mobile deck is supported such that it can be moved, for example lifted, skidded or pivoted, between:
  - an active position, in which the working deck preferably rests on the guide rails of the BOP transport track, and extends in a substantially horizontal direction such that it covers a portion of the moonpool while the firing line extends through the mobile working deck, and
  - a non-active position, in which the BOP transport cart can be positioned above the moonpool for receiving and/or releasing a BOP in the firing line.

In a further embodiment, the BOP transport cart is provided with a door or insert, for closing off the lateral opening of the BOP transport frame, more in particular to provide a structural connection between section of the BOP support frame on opposite sides of the lateral opening, to provide the support frame with additional structural strength and/or rigidity while supporting the BOP. In such an embodiment, the door or insert, is removed when the BOP cart is moved in position above the moonpool, and replaced prior to the BOP being received by the support frame.

The invention furthermore provides a method of lowering a BOP from an offshore drilling vessel comprising a BOP transport system according to the second aspect of the invention, wherein the mobile working deck is brought from its active position into its non-active position and the BOP is brought into the first firing line now cleared by the mobile working deck.

BRIEF DESCRIPTION OF THE DRAWINGS

FIG. 1 shows an offshore drilling vessel 1 according to the invention in cross section. In the exemplary embodiment shown, the offshore drilling vessel is a monohull type vessel. The vessel comprises a hull 2 having a moonpool 3, and, in the exemplary embodiment shown, a bow 4 and a stern 5. At the bow 4 of the hull 2, the vessel 1 is provided with an accommodation 6 having crew quarters and a bridge. A main deck 7 is supported by the hull 2 and extends between the accommodation 6 and the stern 5 of the vessel 1. A front main deck portion 8 of the main deck 7 extends forward of the moonpool 3 and a rear main deck portion 9 of the main deck 7 extends rearward of the moonpool 3.

Figure 1:
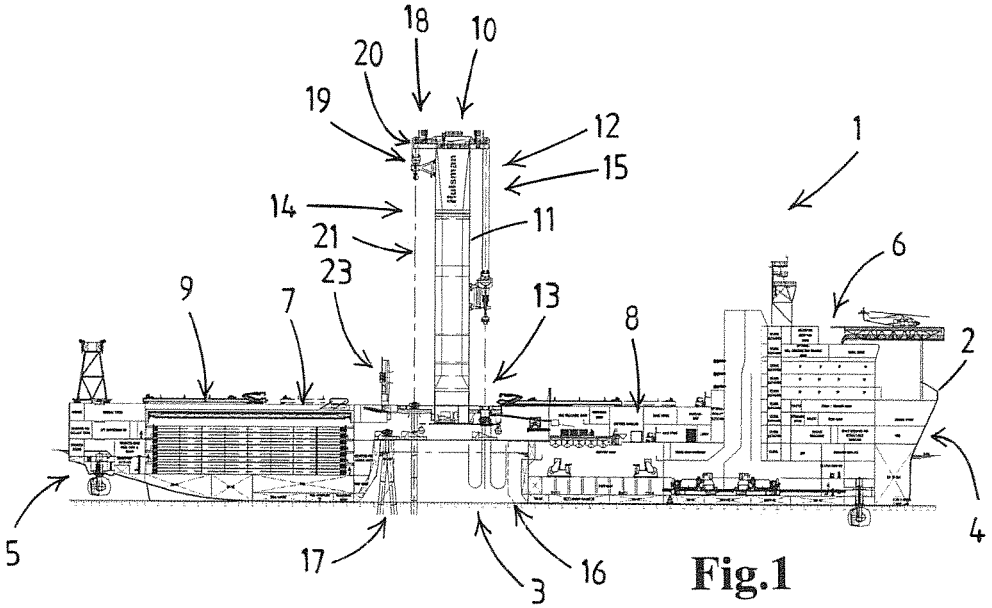
FIG. 1 shows in cross section an example of an off shore drilling vessel according to the invention.

The vessel 1 furthermore has a firing line hoist system 10 supported by the hull 2 above the moonpool 3, and a U-shaped working deck 23 pivotably supported by the hull 2 above the moonpool 3 and adjacent the firing line hoist system 10.

The firing line hoist system 10 comprises a tower 11, in the example embodied in the form of a mast, the mast 11 having a top 12, a base 13, a first side 14, and a second side 15. The base 13 of the mast 11 is connected to the hull 2 of the drilling vessel 1 at opposite sides of the moonpool 3, such that the first side 14 of the mast 11 and the second side 15 of the mast 11 bridge the moonpool 3 in a lateral direction thereof.

Thus, the base 13 of the mast 11 extends between sections of the hull 4 on port and starboard side of the moonpool 3, the base being spaced from the bow side and from the stern side of the moonpool, thereby forming a front moonpool area 16 forward of the mast and a rear moonpool area 17 rearward of the mast.

In an alternative embodiment according to the invention, the tower can be provided adjacent the moonpool such that the first side of the tower faces the moonpool. In an embodiment, the tower is located at the moonpool such that only its first side bridges the moonpool.

The firing line hoist system 10 of the exemplary embodiment shown in the Figs. comprises a first hoisting device 18 at the first side 14 of the mast 11. The first hoisting device 18 comprises a load attachment device 19 displaceable supported by the mast 11, cables 20 and associated winches to manipulate the position of the load attachment device relative to the mast in a vertical direction along a firing line 21. In the exemplary embodiment shown, the associate winches are located inside the mast, and thus not visible in the FIG. The firing line 21 extends on the outside of and adjacent to the first side 14 of the mast 11 and through the moonpool 3. The first hoisting device 18 is adapted for raising and lowering a BOP 22, shown in FIG. 2, to the seabed It is observed that in the embodiment shown, the firing line hoist system 10 comprises a second hoisting device at the second side 15 of the mast 11. This second hoisting device is similar to the first hoisting device. Preferably, a hoisting device according to the invention is thus provided with a first side configured for assembly, disassembly and handling of risers, handling of a BOP and other equipment relevant for risers, and a second side configured for assembly, disassembly and handling of a drill string and equipment relevant for a drill string. In a further embodiment, the firing line hoist system is configured to assemble, disassemble and handle drill strings and risers at both the first and the second side of the mast.

Figure 2:
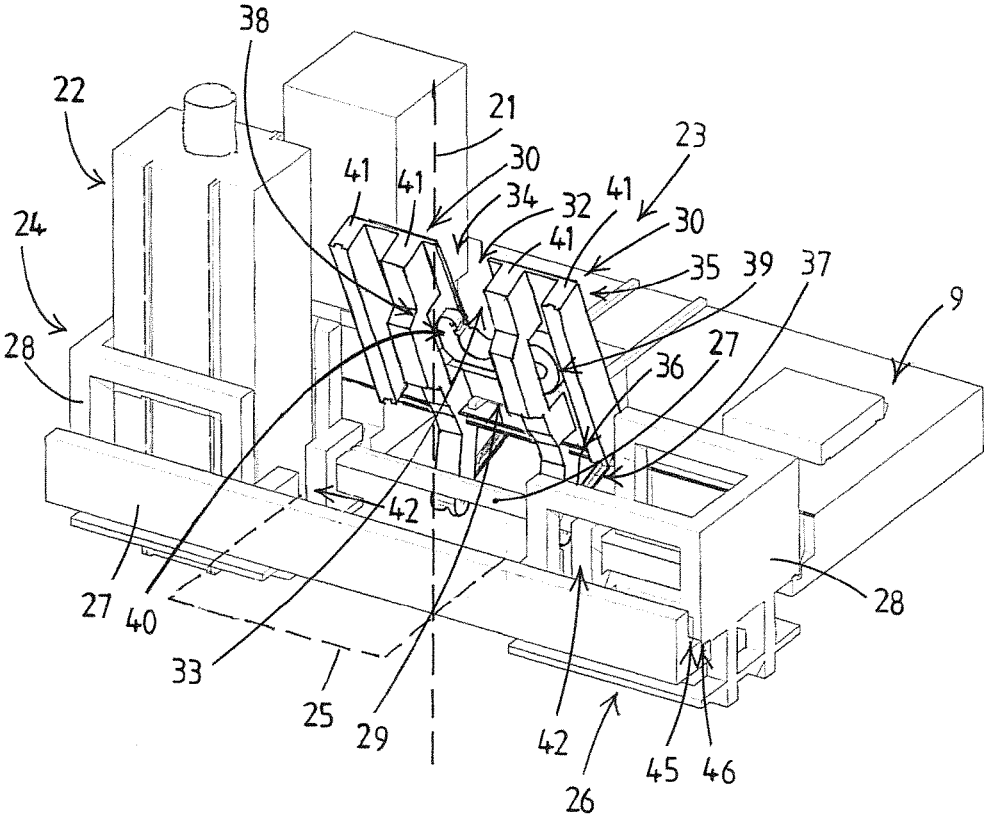
FIG. 2 shows a perspective view in close up of a pivotable working deck and a BOP transport system of FIG. 1.

FIG. 2 shows a perspective view of a pivotable, U-shaped working deck 23 and a BOP transport system 24 provided at the first side of the mast 11 of the firing line hoist system 10. For the sake of clarity, of the mast 11 only the outline is depicted with dotted line 25.

Figure 3:
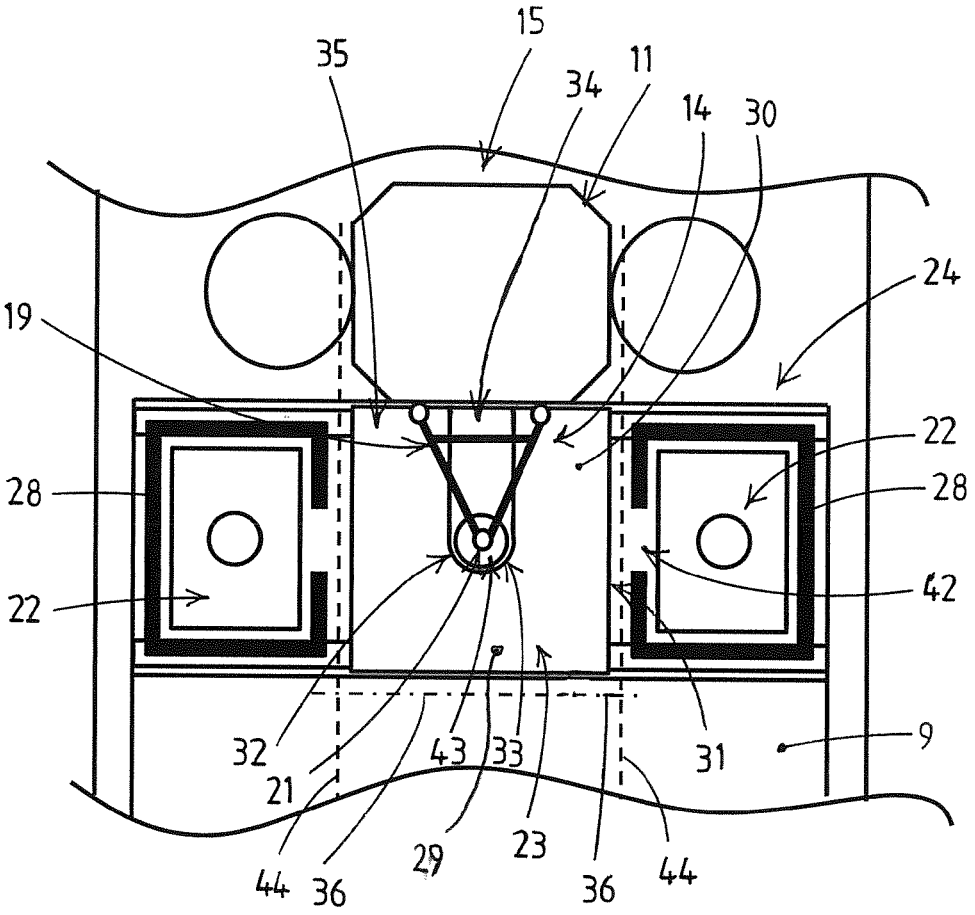
FIG. 3 shows a schematic top view of the pivotable working deck of FIG. 2 in its active position.

FIG. 3 shows a schematic top view of the pivotable working deck 23, the BOP transport system 24, and the first hoisting device 18 of FIG. 2 In this schematic top view, the U-shaped working deck 23 is depicted in its active position, in which It covers a portion of the moonpool 3, the outline of which is indicated with dashed lines 44.

The pivotable U-shaped working deck 23 comprises an elongate slot 32, which at a front end is provided with an open end 34 for receiving a tubular supported in a firing line 21. Thus, a tubular can be positioned in the elongate slot via said opening while the working deck is pivoted into its active position.

At the opposite end, the elongate slot 32 has a closed end 33, which is provided at a central area of the working deck 23. The closed end 33 of the elongate slot is dimensioned such that tubular objects, e.g. a string of tubulars, e.g. a riser string, supported in the firing line can pass through the working deck, more in particular through the closed end of the elongate slot into the sea.

The BOP transport system 24 is provided at the first side of the mast and is configured for moving the BOP 22 between a storage position adjacent the moonpool 4, in which position the BOP is depicted in FIG. 2, and a launch position, in which the BOP is located above the moonpool 3 and in the firing line 21. In the launch position the BOP 22 can be manipulated by the hoisting device 18 of the firing line hoist system 10.

The BOP transport system 24 comprises a BOP transport track 26, the track comprising two parallel guide rails 27 that are supported by the hull 2 such that they bridge the moonpool 3 in a lateral direction thereof. The guide rails 27 extend between sections of the hull 4 on port and starboard side of the moonpool 3, such that the BOP transport track passes over the rear moonpool area adjacent the first side of the mast 11.

Typically, the guide rails of a BOP transport track are provided in the form of beams that cross the moonpool, and that are supported by the hull on opposite sides of the moonpool. In the preferred embodiment shown in FIG. 2, the guide rails 27 of the BOP transport track 26 are provided with a guide surface 45 for supporting the BOP transport carts, and with a separate support surface 46 for supporting the U-shaped working deck 23. By thus providing the guide rails 27 with an additional support surface for supporting the U-shaped working deck, the U shaped working deck does not contact the guide surfaces for guiding the BOP transport carts when the U-shaped working deck rests on the guide rails in its active position. Thus, it is prevented that the BOP transport cart guide surface of the guide rails gets damaged by supporting the U-shaped working deck when in its active position. In an alternative embodiment, the U-shaped working deck, when in its active position, rests on the guide surface of the BOP transport track for supporting the BOP transport carts.

In the particular embodiment shown, the BOP transport system 24 provides two BOP storage positions, one on each sides of the moonpool, and two BOP transport carts 28, one for each storage position.

The BOP transport carts 28 are each configured for supporting a BOP, and are movably supported by the guide rails 27. They can thus move a BOP in a lateral direction between a launching position in the firing line above the moonpool and a parking position adjacent the moonpool.

In the embodiment shown, the BOP transport carts 28 comprise a rectangular frame with a central opening for the BOP to extend through, so that a top portion of the BOP extends above the BOP support frame and a lower portion below the BOP support frame. The rails are spaced apart so as to allow the BOP to pass through between them while supported in a BOP transport cart and during transfer of the BOP to and from the firing line. Thus providing the BOP transport carts 28 with a frame that supports the BOP is preferred as it allows a safe transfer of the usually very heavy and tall BOP.

The BOP transport carts 28 are provided with actuable BOP supports, not visible in the FIG, that in active position support the BOP 22 and in retracted position release the BOP, so that the BOP may be lowered through the support frame into the sea by means of the first hoisting device (commonly after it has been attached to a riser held by the first hoisting device). Providing the BOP transport carts with actuable BOP supports allows for quickly and simply removing a BOP located in its launch position from the BOP transport cart. To remove the BOP from the cart, it is connected to the hoisting device of the firing line hoist system and is subsequently lifted from the actuable BOP supports. The actuable BOP supports are retracted, after which the BOP can be lowered though the cart into the moonpool. Thus, the BOP cart does not need to be removed prior to lowering the BOP towards the moonpool.

This way of lowering the BOP out of the Cart is especially beneficial when the BOP cart is provided with a frame that partially encloses the BOP. Although such a frame may provide additional lateral stability for the BOP during transport, it also required the BOP to be lifted over a substantial height to be removed from the cart. When the BOP had been lifted from the cart, the cart had to be displaced and the BOP would again be lowered towards the moonpool. Therefore, lowering the BOP directly towards the moonpool through the cart is less complicated and thus a quicker process.

It is observed that a BOP can thus also be lifted from the moonpool and be positioned in the cart via the central opening in the cart.

In the preferred embodiment of the BOP transport system 24 shown, the carts 28 are furthermore provided with a lateral opening 42 facing the firing line 21. The lateral opening 42 is dimensioned such that a riser supported in the firing line 21 can pass through it in a lateral direction. Thus, the carts 28 can move freely into and out of a position above the moonpool when a riser is supported in the firing line. Furthermore, when a BOP is supported below the BOP transport system by a tubular, for example a riser section connected to the first hoisting device, the carts of the BOP transport system can freely move into and out of a position above the BOP. This facilitates the process of positioning a cart 28 above the moonpool 3 for receiving a BOP 22 and for moving a cart 28 away from the firing line 21 after lowering the BOP from the cart towards the moonpool.

FIG. 2 furthermore shows the U-shaped working deck 23 provided at the first side 14 of the mast 11 above the parallel guide rails 27 of the BOP transport system 24.

The U-shaped working deck 23 is shown while being pivoted between a functional position, in which the working deck extends in a substantially horizontal direction, and a non-functional position, in which the working deck extends in a substantially vertical direction.

The U-shaped working deck 23 comprises a base part 29, and two leg parts 30, which leg parts are with a proximal end 31 connected to said base part at spaced apart locations such that the leg parts between define an elongate slot 32 for receiving a tubular supported in the firing line 21.

The elongate slot 32 has a closed end 33, located in a central area of the U-shape working deck 23 between the proximal ends 31 of the legs 30, and an open end 34, located at a side of the U-shaped working deck between distal ends 35 of the legs.

The U-shaped working deck 23 is pivotally supported such that it can be pivoted about a working deck pivot axis 36, which working deck pivot axis extends parallel to the guide rails alongside the BOP transport track 26. The working deck pivot axis 36 is located opposite the mast 11 on the other side of the BOP transport track 26.

The U-shaped working deck 23 is furthermore provided with a working deck pivot drive 37, in the embodiment shown in the form of two hydraulic cylinders, to pivot the U-shaped working deck about the working deck pivot axis between its active position and its non-active position.

In its active position, the U-shaped working deck 23 rests on the guide rails 27 of the BOP transport system 24 and extends in a substantially horizontal direction such that it covers a portion of the moonpool 3 while the firing line 21 extends through the elongate slot 32 at the closed end thereof. Thus the deck is accessible by personnel and can be used for performing work. Furthermore, in this position the working deck 23 can be used for supporting objects.

In the particular embodiment shown, the U-shaped working deck 23, when in its active position, is part of the main deck 7, more in particular of the rear portion of the main deck 9. The U-shaped working deck 23 is configured for lowering tubular objects, e.g. a string of tubulars, e.g. a riser string, supported in the firing line 21 through the working deck into the sea.

The U-shaped working deck 23 is at the closed end 33 of the elongate slot, located at the central area of the U-shaped working deck, configured for supporting objects in the firing line, e.g. a string of tubulars, e.g. a riser string. The U-shaped working deck 23 is therefore provided with a suspension device 38 arranged at the closed end 33 of the elongate slot 32. The suspension device 38 in the embodiment shown comprises a clamping device 39 for suspending a string of tubulars from the deck, such as a riser spider. The riser spider type clamping device 39 is provided in two halves, which can be moved between a support position and a storage position. In their support position the two halves from a riser spider type clamp for supporting a riser located in the firing line 21 at the closed end of the elongate slot 32. In their storage position, in which they are depicted in the fig., the two halves are retracted into a position below the deck surface of the U-shaped working deck to clear the elongate slot 32 and allow tubulars to pass through said slot, for example for lowering a riser string supporting a BOP towards the moonpool using the first hoisting device.

In addition to the riser spider clamping device 39, the suspensions device 38 is provided with a C-shaped pipeslip 40 for supporting a tubular in the fringing line. The C-shaped pipe slip is also slideable supported below the deck level of the U-shaped working deck, such that it can be moved between an active position for supporting a tubular in the firing line and a non-active position outside the elongate slot to allow for passing through tubulars.

The mobile working deck may also be provided with other devices and/or clamps, such as a rotary table arranged above the closed end of the elongate opening in the deck, possibly combined with the riser spider. Furthermore, the U-shaped working deck can be configured for temporarily mounting tolls, clamps etc, in or above the elongate slot.

It will be appreciated that the pivotable U-shaped working deck is configured to, in its active position, support the weight of the suspended string of tubulars. In a practical embodiment said weight will be at least 200 tonnes, so the working deck has a structure allowing to support a string of tubulars, e.g. risers, possibly with a BOP attached to the lower end of the string, having a weight of at least 200 tonnes.

In the particular embodiment shown, the U-shaped working deck 23 is provided with four main support beams 41, which main support beams, when the deck is in its active position, cross the BOP transport track and rest on the guide rails of that track. Thus, the U-shaped working deck 23 is, when in its active position, supported by the guide rails 27 of the BOP transport track 26, and the weight of the U-shaped working deck and objects supported by that deck, such as a riser string with a BOP, is transferred via the guide rails 27 onto the hull 2 of the offshore drilling vessel 1. It is observed that in the exemplary embodiment shown, the guide rails 27 are provided with a dedicated support surface 45, other than the guide surface 46 for guiding and supporting the BOP transport carts, for supporting the U-shaped working deck, more in particular the main support beams 41 of the U-shaped working deck, when the working deck is in its active position. By providing such an additional support surface, the U shaped working deck does not contact the guide surfaces for guiding the BOP transport carts when the U-shaped working deck rests on the guide rails in its active position. Thus, it is prevented that the BOP transport cart guide surface of the guide rails gets damaged by supporting the U-shaped working deck when in its active position.

In its non-active position, the U-shaped working deck 23 clears the guide rails 27 of the BOP transport track 27 and extends in a substantially vertical direction such that it provides room for the BOP 22 to be moved by the BOP transport system 24 into its launch position above the moonpool 3, between the mast 11 and the U-shaped working deck 23.

The working deck pivot axis 36 is provided adjacent the base part 29 of the pivotable U-shaped working deck 23, such that when the U-shaped working deck is pivoted from its non-active position into its active position while a tubular is supported in the firing line 21 at deck level, the tubular is received in the elongate slot 32 between the two leg parts 30.

Figure 4:
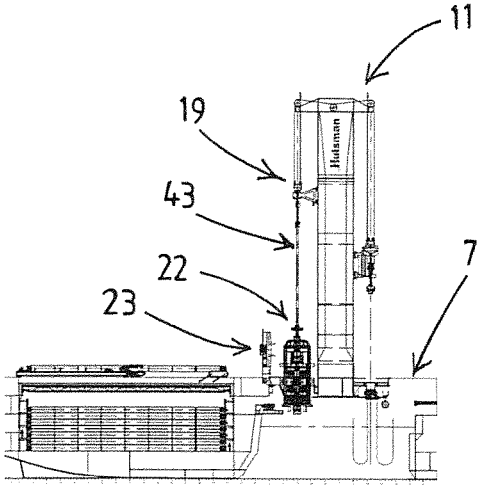
FIGS. 4-6 show subsequent steps of a method for lowering a BOP using a pivotable working deck according to the invention.
Figure 5:
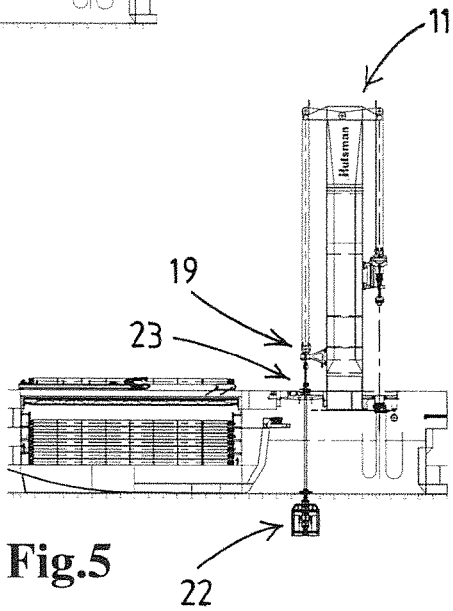
Figure 6:
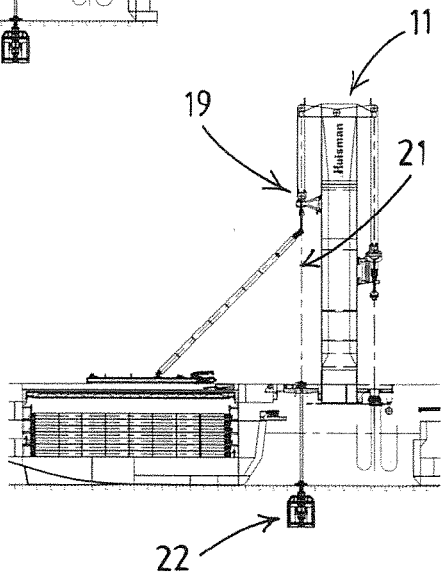

FIGS. 4-6 show subsequent steps of a method for lowering a BOP using a pivotable working deck according to the invention. In the Figs. a section of the drilling vessel of FIG. 1 is shown in cross section.

FIG. 4 shows the U shaped working deck 23 in side view. The U-shaped working deck has been pivoted upwards into its non-active position. In this position, the U-shaped working deck extends in the vertical direction, substantially perpendicular to the deck surface of the main deck 7.

In FIG. 4, the BOP 22 is located in its launch position, i.e. in the firing line 21, between the raised U-shaped working deck 23 and the mast 11. The BOP has already been attached to a riser section 43, which in turn is supported by the load attachment device 19 of the first hoisting device 18.

FIG. 5 shows the BOP 22 after it has been lowered through the BOP cart 28, the cart has been removed in a lateral direction back towards the storage position, and the U-shaped working deck 23 has been lowered into its active position. In this position, the U-shaped working deck 23 extends in a direction substantially parallel to the main deck 7 and provides a working deck adjacent the first side of the mast 11 and above the parallel guide rails of the BOP transport system. The working deck 23 covers a portion of the moonpool 3 at the first side of the mast while the firing line 21 extends through an opening in said mobile working deck. Furthermore, while the U-shaped working deck was pivoted into its active position, it engaged the tubular riser section 43 supporting the BOP 22 in the firing line 21, such that the tubular now passes the elongate slot at the closed end thereof.

FIG. 6 shows how, in the subsequent step, the riser section 43, and the BOP 22 supported thereby, is supported by the suspension device 38 of the U-shaped working deck 23. In this condition, a new riser section can be positioned in the firing line 21, which process is depicted in the Fig. When the new riser section has been positioned in the firing line, it can be attached to the riser section supported by the U-shaped working deck 23, which can then be lowered through the elongate slot of the U-shaped working deck, be supported at its top end by the U-shaped working deck, after which a third riser section can be positioned in the firing line, etc. Thus, a riser string supporting a BOP can be assembled using a U-shaped working deck according to the invention.

The invention claimed is:

1. An offshore drilling vessel comprising:

a hull having a moonpool;

a main deck, which main deck is supported by the hull;

a firing line hoist system, which firing line hoist system is supported by the hull, the firing line hoist system comprising:

a tower, which tower is arranged at said moonpool, and which tower has a top and a base, a first side and a second side, and wherein the base of the tower is connected to the hull of the drilling vessel at the moonpool such that the first side of the tower faces the moonpool; and a hoisting device, which hoisting device comprises a load attachment device displaceable supported by the tower, one or more cables and one or more associated winches to manipulate the position of the load attachment device relative to the tower in a vertical direction along a firing line, which firing line extends on the outside of and adjacent to the first side of the tower and through the moonpool, and the hoisting device is adapted for raising and lowering a BOP to a seabed;

a BOP transport system, provided at the first side of the tower and configured for moving the BOP between a storage position adjacent the moonpool and a launch position above the moonpool, in which launch position the BOP is located in the firing line and is configured to be manipulated by the hoisting device, which BOP transport system comprises:

a BOP transport track, which BOP transport track comprises two parallel guide rails that are supported by the hull such that the guide rails bridge the moonpool in a lateral direction thereof; and a BOP transport cart, which transport cart is movably supported by the guide rails; and a U-shaped working deck, which U-shaped working deck is provided at the first side of the tower above the parallel guide rails of the BOP transport system, which U-shaped working deck comprises a base part, and two leg parts, which leg parts have a proximal end connected to said base part at spaced apart locations such that the leg parts between them define an elongate slot for receiving a tubular supported in the firing line, the elongate slot having a closed end, located in a central area of the U-shape working deck between the proximal ends of the legs, and an open end, located at a side of the U-shaped working deck between distal ends of the legs, wherein the U-shaped working deck is pivotally supported such that the U-shaped working deck is configured to be pivoted about a working deck pivot axis, which working deck pivot axis extends parallel to the guide rails of the BOP transport track and is provided at a distance from the tower such that the BOP transport track extends between the pivot axis and the tower, and wherein a working deck pivot drive is configured to pivot the working deck about said pivot axis between:

an active position, in which the working deck extends in a substantially horizontal direction such that the working deck covers a portion of the moonpool while the firing line extends through the elongate slot at the closed end thereof; and a non-active position, in which the working deck clears the BOP transport track and extends in a substantially vertical direction such that the working deck provides room for the BOP to be moved by the BOP transport system into the launch position above the moonpool between the tower and the working deck, and wherein the working deck is pivotally supported at the base part thereof, such that when the U-shaped working deck is pivoted from the non-active position into the active position while a tubular is supported in the firing line, the tubular is received in the elongate slot between the two leg parts.

2. The offshore drilling vessel according to claim 1, wherein the working deck, when in the active position, rests on at least one of the guide rails of the BOP transport system.

3. The offshore drilling vessel according to claim 2, wherein the U-shaped working deck comprises at least two support beams, which support beams extend parallel to the legs of the U-shaped working deck on opposite sides of the elongate slot, and wherein the support beams rest directly on at least one of the guide rails of the BOP transport track, when the U-shaped working deck is in the active position.

4. The offshore drilling vessel according to claim 3, wherein the U-shaped working deck comprises a suspension device, which suspension device is attached to the support beams, such that a load supported by the suspension device is transferred directly from the suspension device to the support beams.

5. The offshore drilling device according to claim 1, wherein the U-shaped working deck is provided with a suspension device that allows suspending a riser string from the U-shaped working deck in the firing line.

6. The offshore drilling vessel according to claim 1, wherein the elongate slot of the U-shaped working deck extends in a longitudinal direction of the U-shaped working deck and over more than half the length of the U-shaped working deck.

7. The offshore drilling vessel according to claim 1, wherein the U-shaped working deck comprises movable deck parts for, when the U-shaped working deck is in the active position, covering part of the elongate slot while keeping the elongate slot near the closed end uncovered to enable a tubular supported in the firing line to pass through the elongate slot at the closed end thereof.

8. The offshore drilling vessel according to claim 1, wherein the base of the tower is connected to the hull of the drilling vessel at the moonpool at opposite sides thereof, such that at least the first side of the tower bridges the moonpool in a lateral direction thereof.

9. The offshore drilling vessel according claim 8, wherein the base of the tower is connected to the hull of the drilling vessel at the moonpool at opposite sides thereof, such that the first side of the tower and the second side of the tower bridge the moonpool in a lateral direction thereof, and wherein the vessel has a stationary working deck at the second side of the tower, and wherein the pivotable U-shaped working deck, when in the active position, is located at substantially the same height as the stationary working deck is located at.

10. The offshore drilling vessel according to claim 1, wherein the U-shaped pivotable working deck, when in the active position, is located at substantially the same height as the main deck such that objects can be moved in a horizontal direction from the main deck onto the working deck.

11. The offshore drilling vessel according to claim 10, wherein the main deck is provided with transport rails for supporting carts to transport objects over the main deck, and wherein the U-shaped pivotable working deck is provided with transport rails, which, when the U-shaped pivotable working deck is in the active position, are in line with transport rails provided on the working deck such that a cart is configured to be driven over the transport rails from the main deck onto the working deck and vice versa.

12. The offshore drilling vessel according to claim 1, wherein the off shore drilling vessel is a monohull drilling vessel, the monohull having an elongate shape extending along a longitudinal axis, wherein the moonpool has an elongate shape extending along a longitudinal axis, the latter being parallel with the longitudinal axis of the monohull drilling vessel.

13. The offshore drilling vessel according to claim 1, wherein the BOP transport cart has a support frame that is provided with a lateral opening that allows for a tubular to be moved, in a lateral direction, into or out of the BOP support frame.

14. The offshore drilling vessel according to claim 1, wherein the guide rails of the BOP transport track are provided in the form of beams that cross the moonpool, and that are supported by the hull on opposite sides of the moonpool, and wherein at least one of the guiderails of the BOP transport track is provided with a guide surface for supporting and guiding the BOP transport cart and with a separate support surface for supporting the U-shaped working deck.

15. A drilling method comprising the step of using the offshore drilling vessel according to claim 1, the drilling method comprising:

pivoting the U-shaped working deck in a direction upward and away from the tower from the active position to the non-active position;

bringing the BOP into the firing line which is cleared by the pivoted U-shaped working deck; and lowering the BOP to the seabed.

16. A method of lowering a BOP from the offshore drilling vessel according to claim 1, comprising the steps of:

pivoting the U-shaped working deck in a direction upward and away from the tower, from the active position into the non-active position; and bringing the BOP into the firing line which is cleared by the pivoted U-shaped working deck.

17. An offshore drilling vessel comprising:

a hull having a moonpool;

a main deck, which main deck is supported by the hull;

a firing line hoist system, which firing line hoist system is supported by the hull, the firing line hoist system comprising:

a tower, which tower has a top and a base, a first side and a second side, and wherein the base of the tower is connected to the hull of the drilling vessel at opposite sides of the moonpool, such that the first side of the tower and the second side of the tower bridge the moonpool in a lateral direction thereof; and a hoisting device, which hoisting device comprises a load attachment device displaceable supported by the tower, one or more cables and one or more associated winches to manipulate the position of the load attachment device relative to the tower in a vertical direction along a firing line, which firing line extends on the outside of and adjacent to the first side of the tower and through the moonpool, and the hoisting device is adapted for raising and lowering a BOP to a seabed;

a BOP transport system, provided at the first side of the tower and configured for moving a BOP between a storage position adjacent the moonpool and a launch position above the moonpool, in which launch position the BOP is located in the firing line and is configured to be manipulated by the hoisting device, which BOP transport system comprises:

a BOP transport track, which BOP transport track comprises two parallel guide rails that are supported by the hull such that the guide rails bridge the moonpool in a lateral direction thereof; and a BOP transport cart movably supported by the guide rails, the BOP transport cart having a BOP support frame, which support frame is configured for receiving and/or releasing the BOP via a bottom opening and is provided with actuable BOP supports for supporting the BOP in the BOP support frame, and which BOP support frame is provided with a lateral opening for receiving a tubular supported in the firing line in the BOP support frame; and a mobile working deck, which mobile working deck is provided at the first side of the tower above the parallel guide rails of the BOP transport system, and which mobile working deck is supported such that the mobile working deck is configured to be pivoted between:

an active position, in which the mobile working deck extends in a substantially horizontal direction such that the mobile working deck covers a portion of the moonpool while the firing line extends through the mobile working deck; and a non-active position, in which the BOP transport cart is configured to be positioned above the moonpool for receiving and/or releasing the BOP in the firing line.

* * * * *